US009580910B1

(12) United States Patent
Morris et al.

(10) Patent No.: US 9,580,910 B1
(45) Date of Patent: Feb. 28, 2017

(54) OPERABLE RAMP

(71) Applicants: Donald Morris, Littleton, CO (US); George Franco, Riverbank, CA (US); David Johnson, Modesto, CA (US)

(72) Inventors: Donald Morris, Littleton, CO (US); George Franco, Riverbank, CA (US); David Johnson, Modesto, CA (US)

(73) Assignee: Lift-U, division of Hogan Mfg. Inc., Escalon, CA (US)

( * ) Notice: Subject to any disclaimer, the term of this patent is extended or adjusted under 35 U.S.C. 154(b) by 0 days.

(21) Appl. No.: 14/852,384

(22) Filed: Sep. 11, 2015

(51) Int. Cl.
*E04F 11/00* (2006.01)

(52) U.S. Cl.
CPC ..... *E04F 11/002* (2013.01); *E04F 2011/005* (2013.01)

(58) Field of Classification Search
CPC ..... E04F 2011/005; E04F 2011/007; E04F 2011/0203; E04F 11/02; E04F 11/062; E04F 11/1041
USPC ..... 14/71.3; 52/183; 187/200; 414/921
See application file for complete search history.

(56) References Cited

U.S. PATENT DOCUMENTS 3,902,213 A 9/1975 Pfleger et al.
3,955,827 A * 5/1976 Wonigar ..... B60R 3/02 105/445
4,022,237 A 5/1977 Wertheimer
4,027,807 A 6/1977 Thorley
4,081,091 A 3/1978 Thorley
4,124,096 A 11/1978 Dudynskyj et al.
4,124,098 A 11/1978 Dudynskyj
4,124,099 A 11/1978 Dudynskyj
4,164,292 A 8/1979 Karkau
4,176,999 A 12/1979 Thorley
4,180,366 A 12/1979 Roth et al.
4,251,179 A 2/1981 Thorley
4,270,630 A 6/1981 Karkau
4,285,416 A 8/1981 Dudynskyj
4,559,659 A 12/1985 Hunter, Jr.
4,583,466 A 4/1986 Reddy et al.
5,230,288 A 7/1993 Bickel
5,284,414 A 2/1994 Kempf
5,316,432 A 5/1994 Smalley et al.
5,425,615 A 6/1995 Hall et al.
5,439,342 A 8/1995 Hall et al.
5,454,196 A 10/1995 Gaines et al.
5,813,072 A 9/1998 Alexander
5,947,231 A 9/1999 Raab et al.
(Continued)

*Primary Examiner* — Gary Hartmann
(74) *Attorney, Agent, or Firm* — Christensen O'Connor Johnson; Matthew Balint

(57) ABSTRACT

An operable ramp is moveable between a raised position, in which the ramp forms a pair of steps, and a lowered position, in which the operable ramp provides an inclined surface. The operable ramp includes a first panel rotatably coupled about a first axis that moves back and forth when the operable ramp moves between the lowered position and the raised position. A link is rotatably coupled to the first panel about a second axis and is itself rotatable about a fixed third axis. A second panel is rotatably coupled to the link between the second axis and the third axis, and a third panel is rotatably coupled to the second panel about a fourth axis. When the ramp moves between the raised and lowered positions, the fourth axis rotates about a fixed fifth axis. A linkage selectively rotates the first panel about the first axis.

19 Claims, 16 Drawing Sheets

(56) References Cited

U.S. PATENT DOCUMENTS

| | | | | |
|---|---|---|---|---|
| 6,082,751 | A * | 7/2000 | Hanes | B60R 3/02 280/163 |
| 6,484,344 | B1 | 11/2002 | Cooper | |
| 6,558,106 | B2 * | 5/2003 | Sardonico | B60P 1/445 254/10 R |
| 6,764,123 | B1 | 7/2004 | Bilyard | |
| 6,931,686 | B2 | 8/2005 | Hoofard et al. | |
| 7,062,813 | B2 | 6/2006 | Hoofard et al. | |
| 7,162,761 | B2 | 1/2007 | Alexander et al. | |
| 7,216,392 | B2 | 5/2007 | Hoofard et al. | |
| 7,225,493 | B2 | 6/2007 | Hoofard et al. | |
| 7,500,818 | B1 * | 3/2009 | Johnson | A61G 3/06 414/546 |
| 8,161,589 | B1 | 4/2012 | Heffernan et al. | |
| 8,631,529 | B1 | 1/2014 | Johnson et al. | |
| 8,739,342 | B1 | 6/2014 | Johnson et al. | |
| 8,813,290 | B1 | 8/2014 | Morris | |
| 8,832,893 | B1 | 9/2014 | Morris et al. | |
| 8,887,337 | B1 | 11/2014 | Morris et al. | |
| 8,918,939 | B1 * | 12/2014 | Morris | E04F 11/002 14/71.1 |
| 8,925,131 | B1 * | 1/2015 | Morris | E04F 11/002 14/71.3 |
| 8,943,631 | B1 * | 2/2015 | Morris | B66B 9/08 14/71.3 |
| 9,045,908 | B1 * | 6/2015 | Morris | E04F 11/002 |
| 2003/0051299 | A1 * | 3/2003 | Bearint | A61G 3/061 14/69.5 |

* cited by examiner

OPERABLE RAMP

BACKGROUND

The Americans with Disabilities Act (ADA) requires the removal of physical obstacles to those who are physically challenged. The stated objective of this legislation has increased public awareness and concern over the requirements of the physically challenged. Consequentially, there has been more emphasis on providing systems that enable physically challenged people to access buildings and other architectural structures that have a step at the point of ingress or egress.

Installing a fixed ramp is a common way to provide the physically challenged with access to a building with one or more steps at the entrance. Fixed ramps take up a large amount of space and often detract from the aesthetic qualities of the building. Fold out ramps, similar to those used in vehicles can be utilized, but deployment often requires a large area into which the ramp deploys.

U.S. Pat. No. 8,887,337, issued to Morris et al., which is incorporated herein by reference in its entirety, discloses an operable ramp that is suitable for installation in an architectural setting that includes a step. The operable ramp moves between a raised position and a lowered position. In the raised position, the operable ramp forms a step that blends in with the fixed step, thereby maintaining the aesthetic qualities of the architecture. In the lowered position, the operable ramp forms an inclined surface that provides access between the upper surface and the lower surface.

Building codes set a maximum rise for steps, and as result, a second step is often required when the distance between the upper and lower surfaces exceeds the maximum distance allowed for a single step. Accordingly, there is a need for a ramp that provides access to a building with two steps at the entrance, while minimizing the space required by the ramp.

SUMMARY

A first representative embodiment of a disclosed operable ramp is moveable between a raised position, in which the ramp forms a pair of steps, and a lowered position, in which the operable ramp provides an inclined surface. The operable ramp includes a first panel rotatably coupled about a first axis that moves back and forth when the operable ramp moves between the lowered position and the raised position. A link is rotatably coupled to the first panel about a second axis and is itself rotatable about a fixed third axis. A second panel is rotatably coupled to the link between the second axis and the third axis, and a third panel is rotatably coupled to the second panel about a fourth axis. When the ramp moves between the raised and lowered positions, the fourth axis rotates about a fixed fifth axis. A linkage selectively rotates the first panel about the first axis.

A second representative embodiment of a disclosed operable ramp is moveable between a raised position and a lowered position, wherein the operable ramp forms a pair of steps in the raised position. The operable ramp has a first panel rotatably coupled at a first end about a first axis. The first axis moves in a first direction when the operable ramp moves toward the lowered position and in a second direction when the operable ramp moves toward the raised position. A second panel is rotatably coupled to the first panel and extends downward from the first panel in the raised position. The second panel rotates about a fixed second axis when the operable ramp moves from the raised position to the lowered position. A third panel is rotatably coupled to a second end of the second panel and extends outward from the second panel when the ramp is in the raised position. A fourth panel is rotatably coupled to a second end of the third panel and extends downward from the third panel in the raised position. The fourth panel rotates about a fixed third axis when the operable ramp moves from the raised position to the lowered position.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Exemplary embodiments of the presently disclosed operable ramp will now be described with reference to the accompanying drawings, where like numerals correspond to like elements. Exemplary embodiments of the disclosed subject matter are directed to operable ramps, and more specifically, to operable ramps that are selectively moveable between a raised "step" position and a lowered "ramp" position. In particular, several embodiments of the present invention are directed to operable ramps for use in architectural settings such as building entrances in which the indoor and outdoor levels differ, for example, when the building entrance includes one or more steps.

The following discussion proceeds with reference to examples of operable ramps suitable for use at building entrances wherein there is a change in elevation, i.e., a step up or step down. While the examples provided herein have been described with reference to their association with building entrances, it will be apparent to one skilled in the art that this is done for illustrative purposes and should not be construed as limiting the scope of the disclosed subject matter, as claimed. Thus, it will be apparent to one skilled in the art that aspects of the disclosed operable ramp may be employed in a number of architectural settings in which a change in elevation, such as one or more steps, provides an obstruction to a person with limited mobility.

The following detailed description may use illustrative terms such as higher, lower, inner, outer, vertical, horizontal, front, rear, proximal, distal, etc.; however, these terms are descriptive in nature and should not be construed as limiting. Further, it will be appreciated that embodiments of the disclosed subject matter may employ any combination of features.

Figure 1:
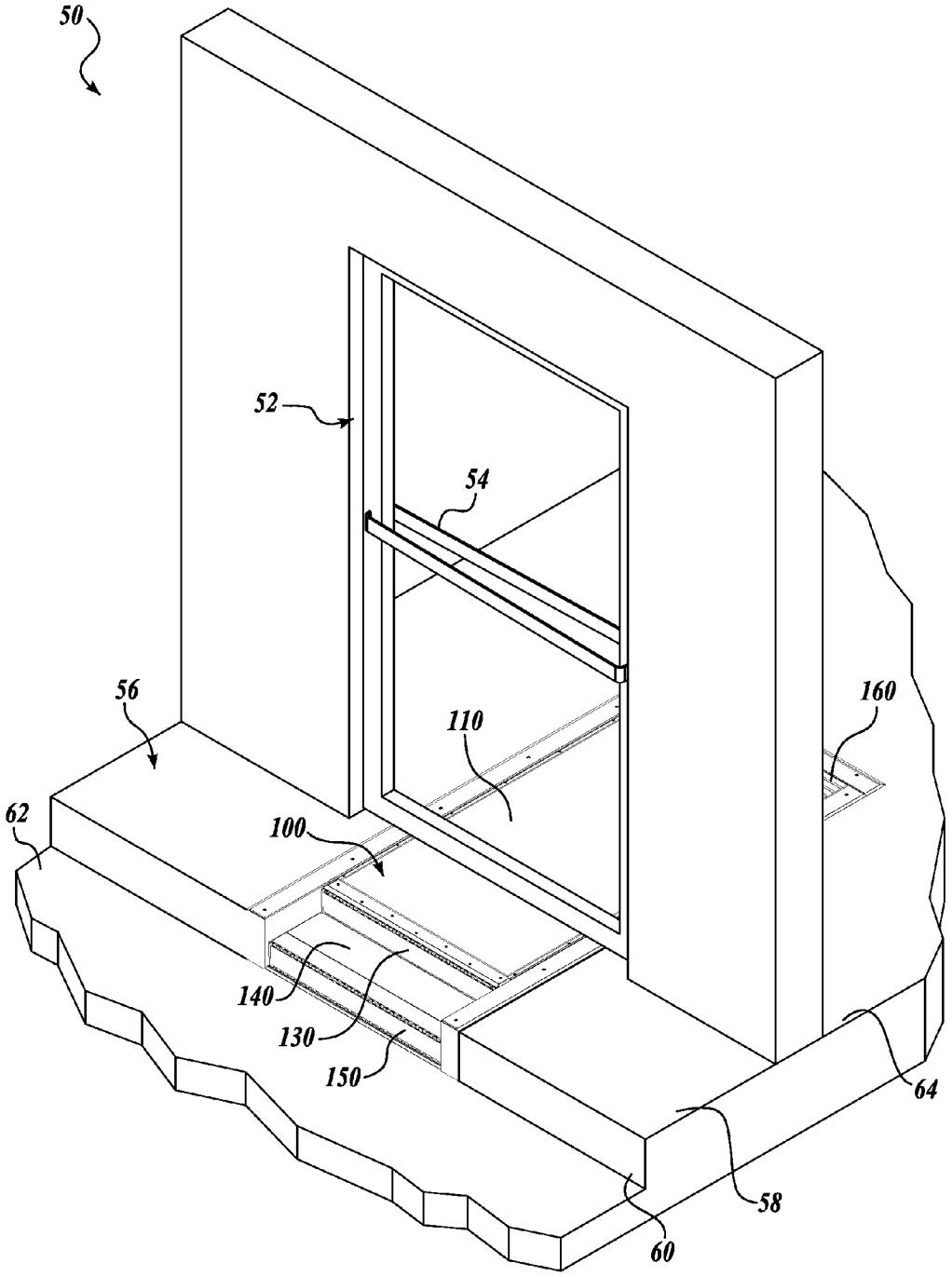
FIG. 1 shows a front isometric view of an exemplary embodiment of an operable ramp installed in a doorway of an architectural setting with the operable ramp in a raised position and the door closed.
Figure 2:
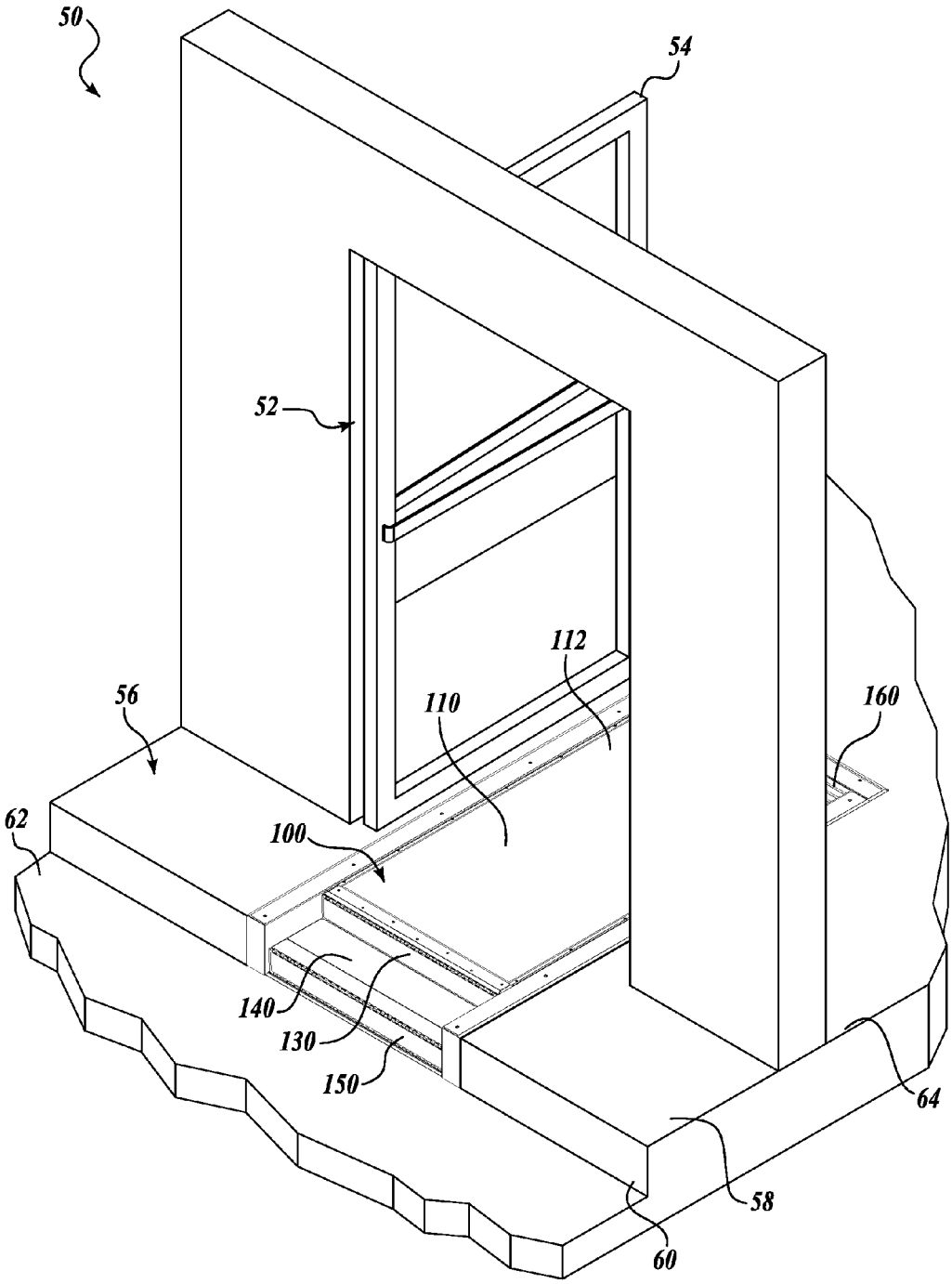
FIG. 2 shows a front isometric view of the operable ramp of FIG. 1 with the door open.
Figure 3:
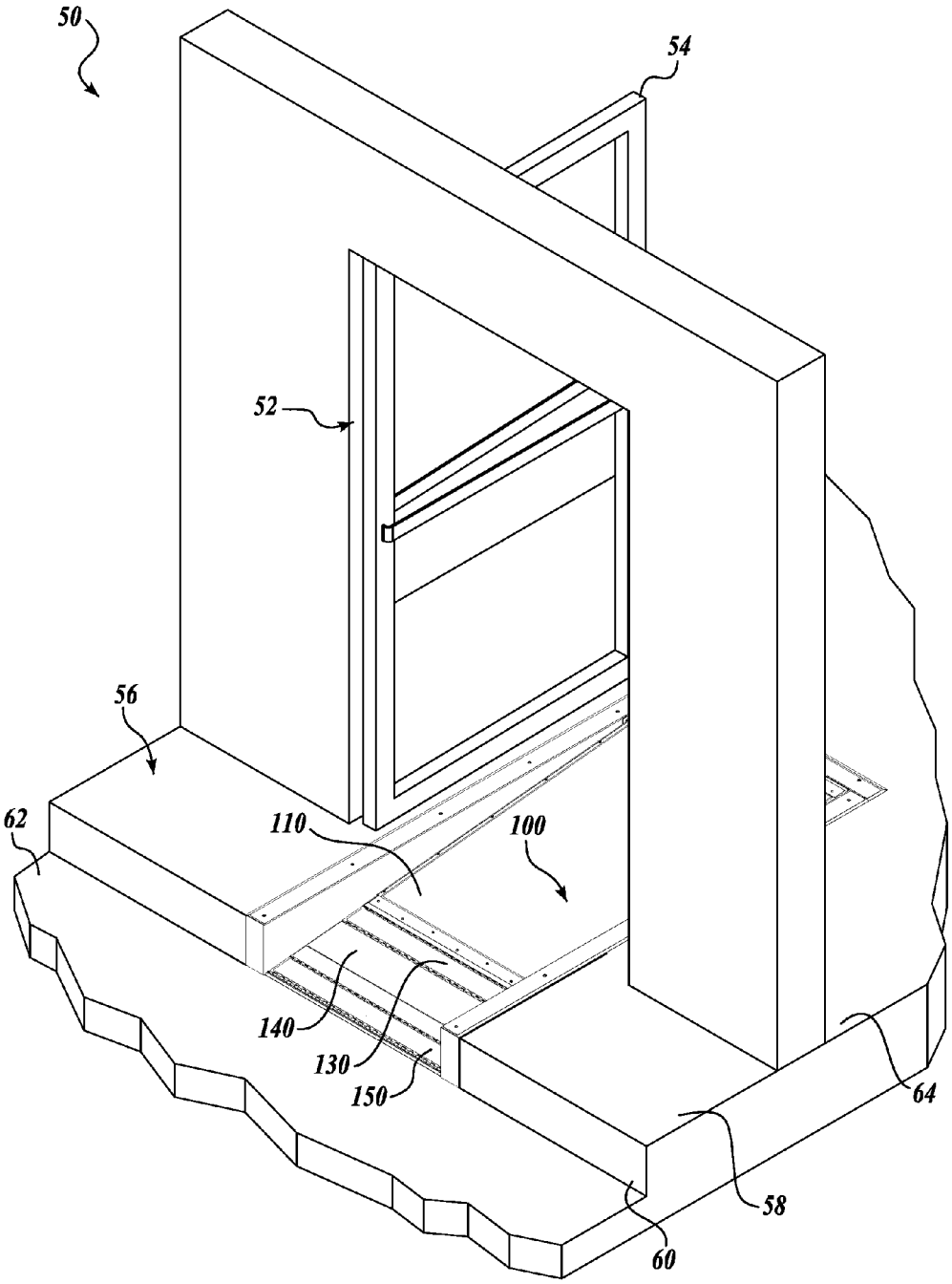
FIG. 3 shows a front isometric view of the operable ramp of FIG. 2 in a lowered position.
Figure 4:
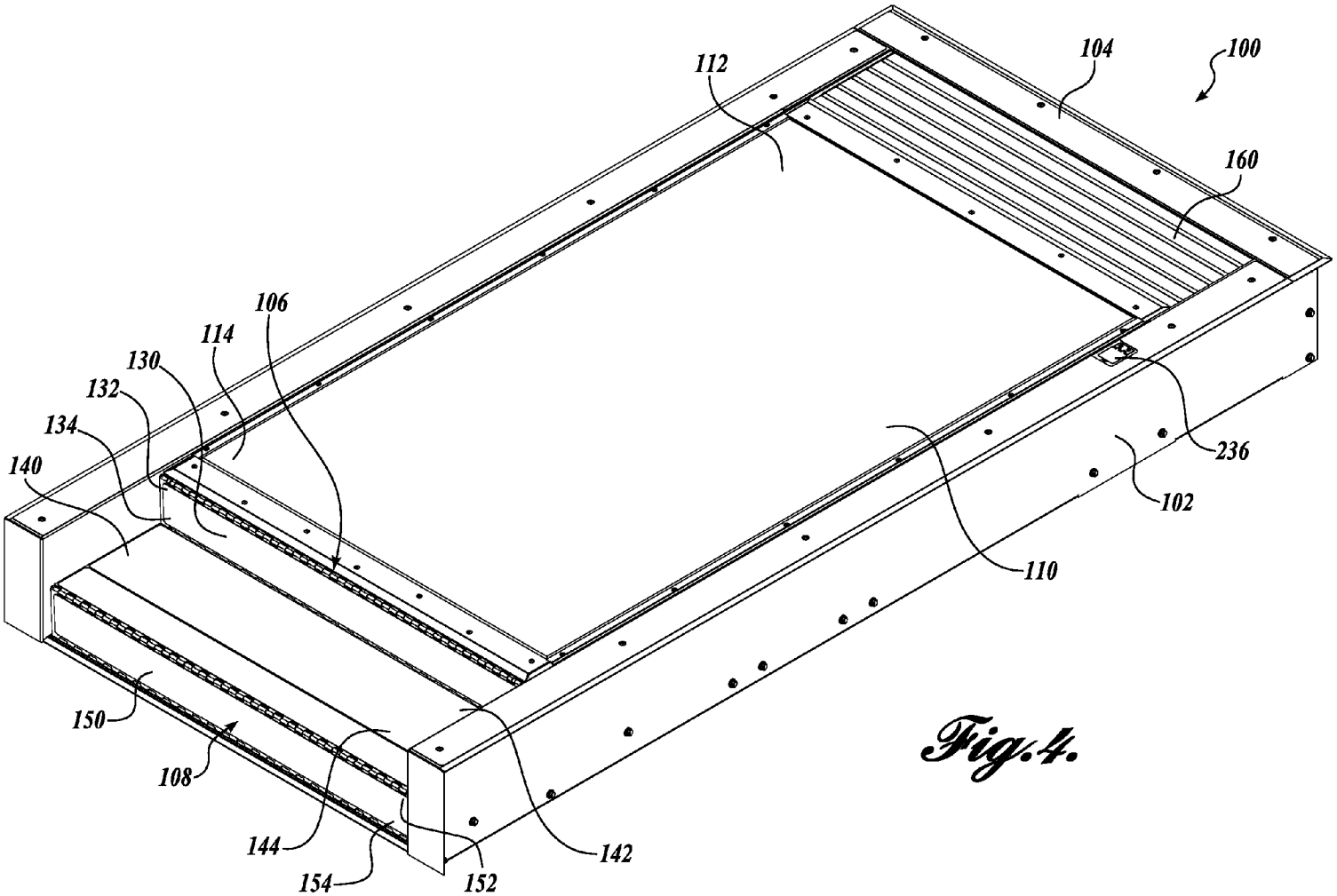
FIG. 4 shows a front isometric view of the operable ramp of FIG. 1 in the raised position.
Figure 5:
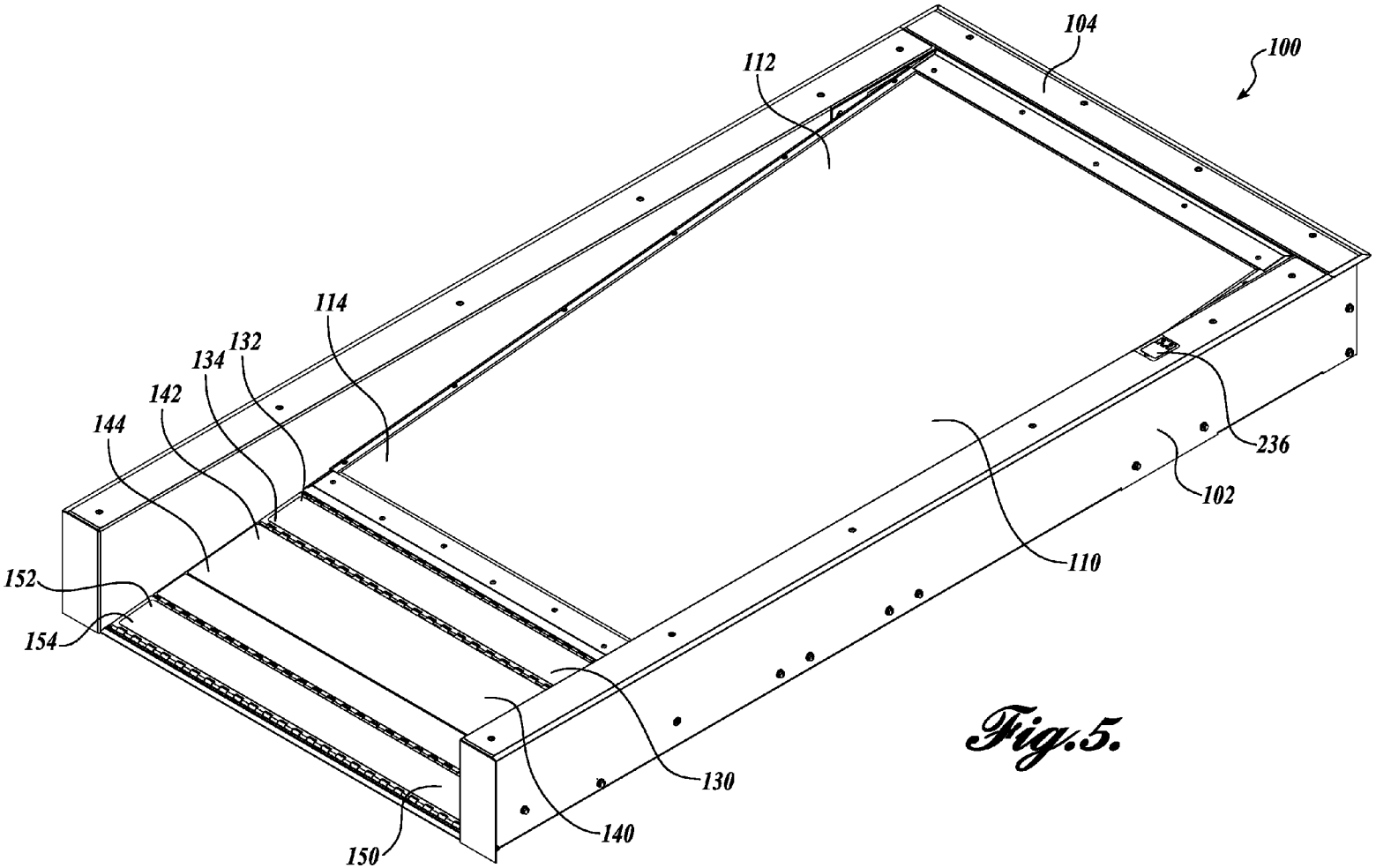
FIG. 5 shows a front isometric view of the operable ramp of FIG. 4 in the lowered position.

FIGS. 1-5 show a representative embodiment of a described operable ramp 100. More specifically, FIGS. 1-3 show an operable ramp 100 shown installed at the entrance 52 of a building 50, and FIGS. 4 and 5 show the same embodiment in isolation, i.e., not installed. Referring to FIGS. 1-3, an exemplary entrance 52 includes a door 54 with a step 56 positioned outside of the door. The step 56 includes a tread portion 58 and a riser portion 60. The tread portion 58 of the step 56 is level with the floor of the building 50 so that a person walking into the building uses the step to step up from a lower first surface 62 outside the building to a higher second surface 64 inside the building. It will be appreciated that the illustrated installation of the operable ramp 100 is exemplary only and should not be considered limiting. In this regard, the operable ramp 100 can be installed in any number of architectural settings having one or more steps that would present an obstacle for a physically challenged person.

FIGS. 1, 2, and 4 show the operable ramp 100 in a raised position. The operable ramp 100 includes a first panel 110 coupled to a second panel 130, a third panel 140 coupled to the second panel, and a fourth panel 150 coupled to the third panel. In the raised position, the operable ramp 100 forms a pair of steps such that the first panel 110 is generally horizontal and flush with the second surface 64, and the second panel 130 extends downward from the outer end 114 of the first panel 110 to the third panel 140. The third panel 140 extends horizontally outward from the second panel 130, and the fourth panel 150 extends downward from the third panel 140 to the first surface 62. Thus, when the operable ramp 100 is in the raised position, the first panel 110 and the second panel 130 form a first (upper) step, wherein the first panel 110 is the tread of the first step, and the second panel 130 is the riser. At the same time, the third panel 140 and the fourth panel 150 form a second (lower) step, wherein the third panel 140 is the tread of the lower step, and the fourth panel 150 is the riser.

When the operable ramp 100 is in the lowered position of FIGS. 3 and 5, the first panel 110 slopes downward from its inner end 112 to the upper end 132 of the second panel 130, and the second panel slopes downward from its upper end to the inner end 142 of the third panel 140. The third panel 140 slopes downward toward its outer end 144, which is coupled to the upper end 152 of the fourth panel 150. The fourth panel 150 slopes downward from its upper end 152 to the lower end 154, which is proximate to the first surface 62. Thus, the first panel 110, second panel 130, third panel 140, and fourth panel 150 cooperate to provide a transition surface that extends from the lower first surface 62 to the higher second surface 64 when the operable ramp 100 is in the lowered (ramp) position.

The panels of the representative embodiment are illustrated as being generally parallel when the operable ramp 100 is in the lowered position. This embodiment is generally preferable because it ensures that the slope of any particular panel will be no greater than that of any other panel, thereby minimizing the slope a person may encounter at any particular location on the ramp. That is the ramp will not have a "steep" portion, which provides for a smoother, more predictable transition between the upper and lower surfaces 58 and 62. However, it will be appreciated that alternate embodiments are possible. In this regard, one or more of the panels may form an angle with an adjacent panel such that different parts of the ramp have different slopes. Such alternate embodiments are contemplated and should be considered within the scope of the present disclosure.

Referring to FIGS. 4 and 5, the operable ramp 100 includes a frame 102. The frame provides a structure with a fixed position to which the components of the operable ramp 100 are attached. To install the operable ramp 100 in an architectural setting, the frame 102 is attached to surrounding structure to secure the operable ramp in place. Although the illustrated embodiments of the operable ramp 100 include a frame 102, other embodiments are contemplated in which the operable ramp 100 does not include a frame. To install such embodiments in architectural settings, the operable ramp 100 components are attached directly to the surrounding structure or to suitable structure within the building, thus making a frame 102 unnecessary. Accordingly, the present disclosure is not limited to embodiments of an operable ramp 100 that have a frame 102, but also includes embodiments that do not include a frame 102.

Referring to FIGS. 4, 5, 8, and 9, the first panel 110 is a generally rectangular panel formed of known materials to have suitable strength and durability such that the panel can withstand user traffic in both the raised (step) and lowered (ramp) positions. In one exemplary embodiment, the first panel 110 is formed from one or more pieces of sheet metal (such as aluminum or steel), with a plurality of stiffeners attached to the bottom of the panel to provide additional stiffness. A texture is preferably formed integrally with or applied to the upper surface of the first panel 110 to provide increased traction.

The outer end 114 of the first panel 110 is rotatably coupled to the upper end 132 of the second panel 130 about an axis 300 with a hinge or other suitable structure. Similar to the first panel 110, the second panel 130 is generally rectangular and constructed of well-known materials having suitable strength and durability to withstand user traffic in the lowered (ramp) position. In one exemplary embodiment, the second panel 130 is formed from one or more pieces of sheet metal (such as aluminum or steel), with a plurality of stiffeners attached to the bottom of the panel to provide additional stiffness. A texture is preferably formed integrally with or applied to the upper surface of the second panel 130 to provide increased traction.

Figure 8:
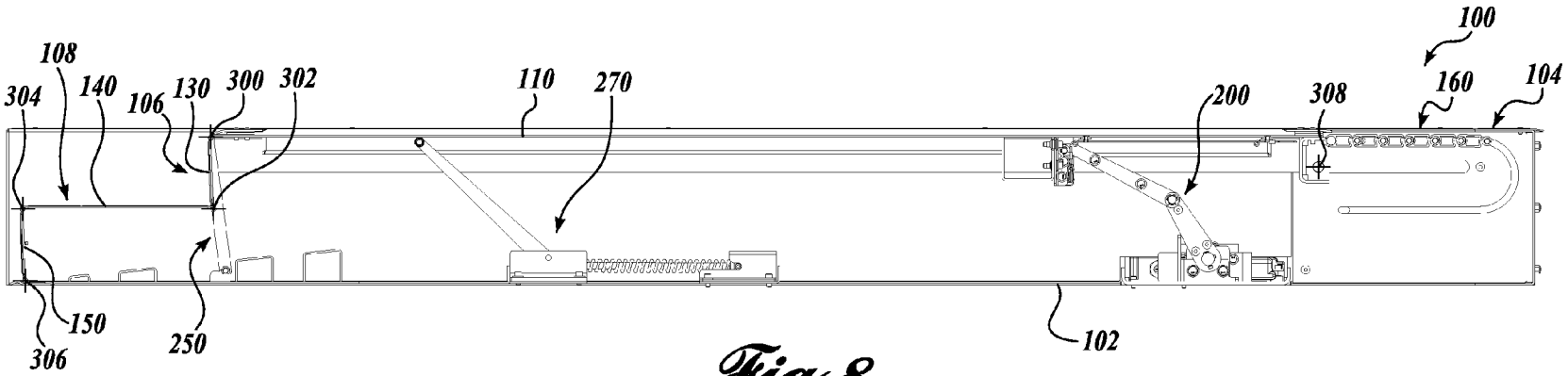
FIG. 8 shows a cutaway side view of the operable ramp of FIG. 4 in the raised position.

The lower end 134 of the second panel 130 is rotatably coupled with a hinge or other suitable structure to an inner end 142 of the third panel 140 about an axis 302, which is generally parallel to axis 300. As best shown in FIGS. 4 and 8, when the ramp assembly 100 is in the raised position, the first panel 110 and second panel 130 form the tread and riser, respectively, of an upper step 106.

Still referring to FIGS. 4, 5, 8, and 9, the third panel 140 is a generally rectangular panel formed of known materials to have suitable strength and durability such that the panel can withstand user traffic in both the raised (step) and lowered (ramp) positions. In one exemplary embodiment, the third panel 140 is formed from one or more pieces of sheet metal (such as aluminum or steel), with a plurality of stiffeners attached to the bottom of the panel to provide additional stiffness. A texture is preferably formed integrally with or applied to the upper surface of the third panel 140 to provide increased traction.

When the ramp assembly 100 is in the raised position, the third panel 140 extends outwardly from axis 302 to provide a generally horizontal stepping surface. The outer end 144 of the third panel 140 is rotatably coupled to an upper end 152 of the fourth panel 150 about an axis 304, which is generally parallel to axis 302.

The fourth panel 150 generally rectangular and constructed of well-known materials having suitable strength and durability to withstand user traffic in the lowered (ramp) position. In one exemplary embodiment, the fourth panel 150 is formed from one or more pieces of sheet metal (such as aluminum or steel), with a plurality of stiffeners attached to the bottom of the panel to provide additional stiffness. A texture is preferably formed integrally with or applied to the upper surface of the fourth panel 150 to provide increased traction.

The lower end 154 of the fourth panel 150 is rotatably coupled with a hinge or other suitable structure to the frame 102 about an axis 306, which is generally parallel to axis 304. As best shown in FIGS. 4 and 8, when the ramp assembly 100 is in the raised position, the third panel 140 and fourth panel 150 form the tread and riser, respectively, of a lower step 108.

Several axes of the representative ramp are described as being parallel, generally parallel, or the like. It will be appreciated that the axes need not be exactly parallel, but can vary within standard manufacturing and assembly tolerances. In this regard, variations between axes are anticipated and acceptable within the present disclosure provided that these variations do not interfere with the operation of the ramp. That is, variations from parallel between the axes that do not cause binding, misalignment between the panels, or other anomalies, are contemplated and should be considered within the scope of the present disclosure.

Figure 14:
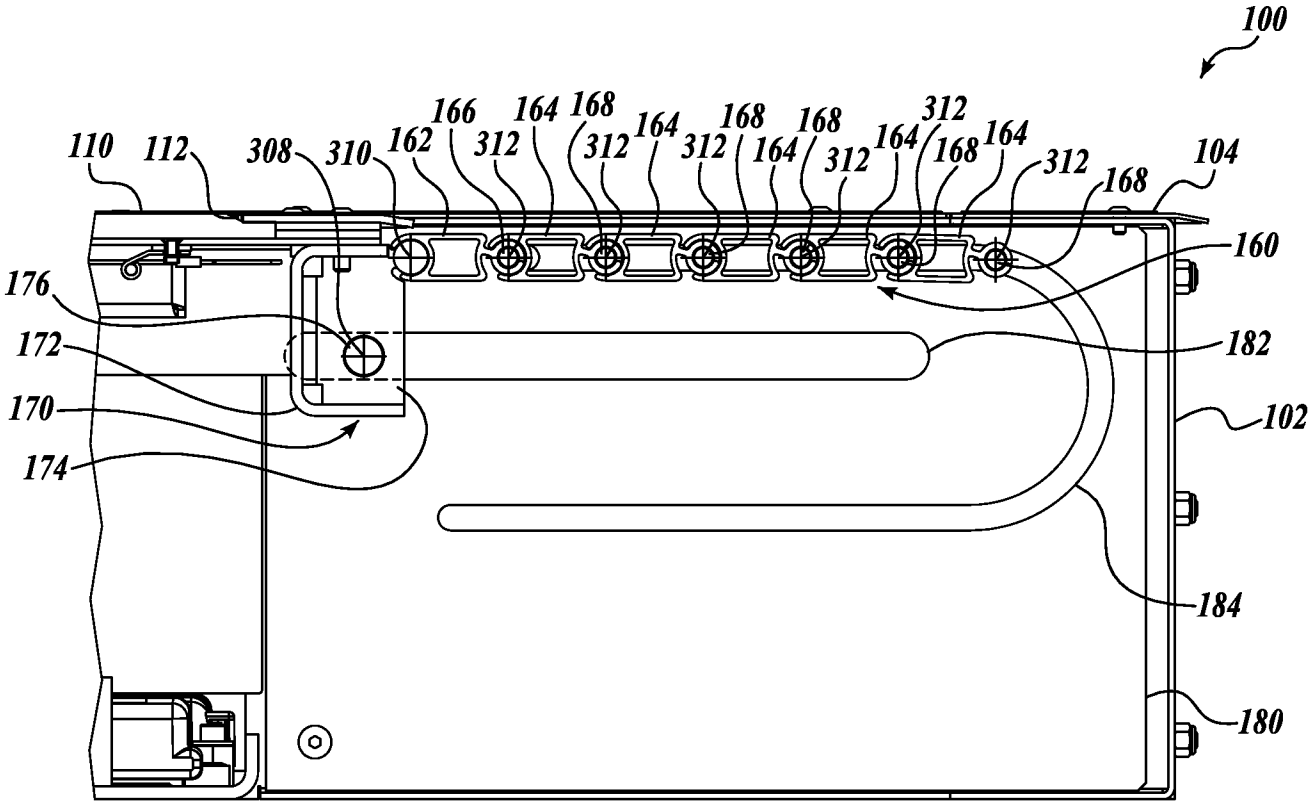
FIG. 14 shows a cutaway side view of a retractable portion of the operable ramp of FIG. 8 with the operable ramp in the raised position.
Figure 15:
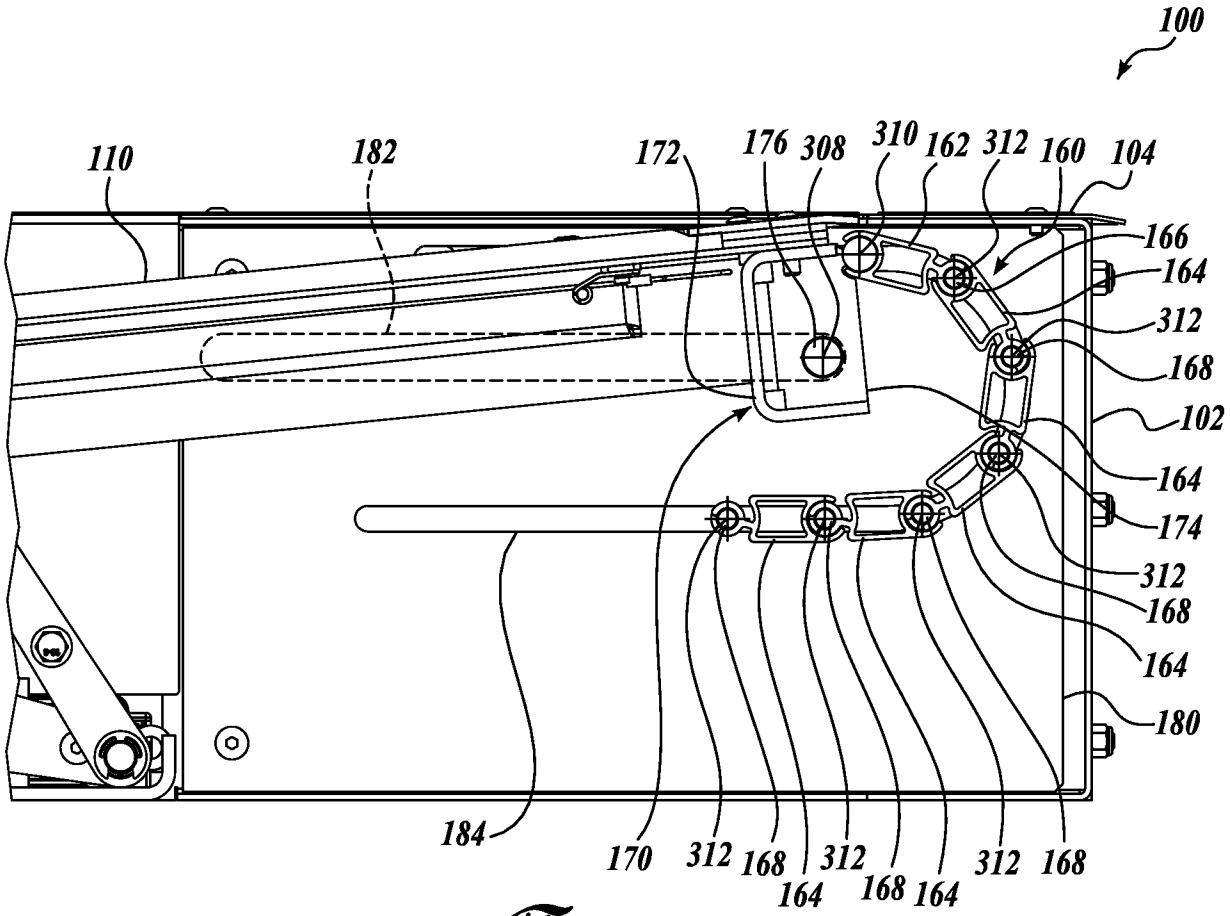
FIG. 15 shows a cutaway side view of the retractable portion of FIG. 8 with the operable ramp in the lowered position.

As shown in FIGS. 14 and 15, the inner end 112 of the first panel 110 is coupled to a pivot fitting 170. The pivot fitting 170 includes a C-channel portion 172 extending approximately the width of the first panel 110 and a closeout 174 disposed at each end thereof. The pivot fitting 170 further includes bearing elements 176 that extend laterally outward from each closeout 174. The pivot fitting 170 is sized and configured to support the inner end 112 of the first panel 110 when the ramp is positioned in both the raised and lowered positions. It will be appreciated that the disclosed configuration is exemplary only and should not be considered limiting. In this regard various alternate configurations of the pivot fitting 170 would be suitable and should be considered within the scope of the present disclosure.

Figure 6:
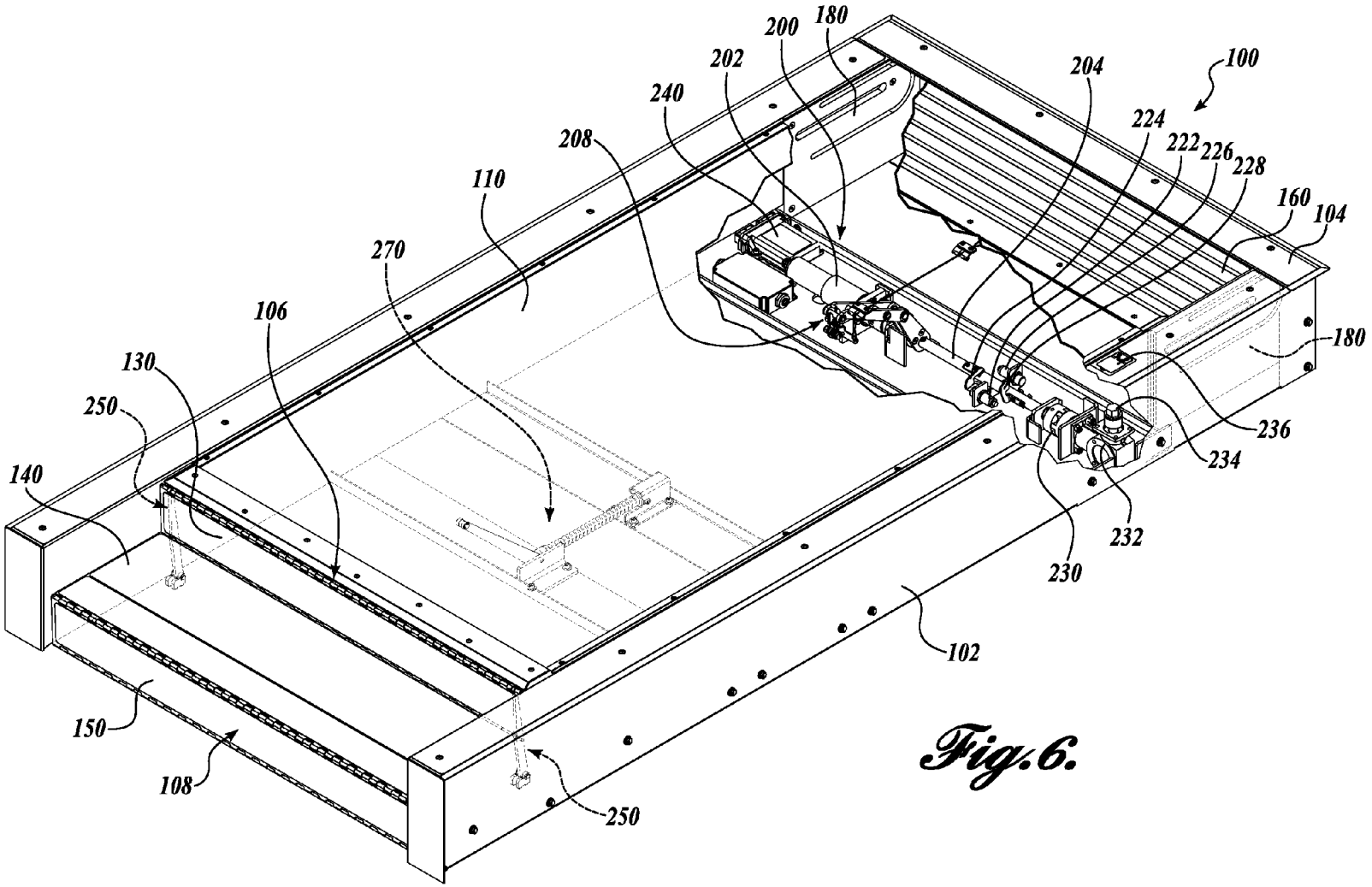
FIG. 6 shows a partially cutaway front isometric view of the operable ramp of FIG. 4 in the raised position.

As best shown in FIG. 6, a guide 180 is coupled to each side of the frame 102 at the inner end of the operable ramp 100. A horizontal elongate slot 182 is formed in each guide 180. Each elongate slot 182 receives one of the bearing elements 176 of the pivot fitting 170. The bearing elements 176 are disposed within the elongate slots 182 such that the pivot fitting 170 and, therefore, the inner end 112 of the first panel 110 are translatable along the length of the slots. In addition, the pivot fitting 170 is rotatable relative to the guides 180 about an axis 308. To allow for rotation about axis 308, the bearing elements 176 are rotatable within the elongate slots 182 and/or the bearing elements are rotatable relative to the pivot fitting 170.

Referring back to FIGS. 14 and 15, a retractable panel 160 is rotatably coupled at one end to the pivot fitting 170 about an axis 310. In the illustrated embodiment, the retractable panel 160 includes a plurality of cross-members 162 and 164 extending between the guides 180 and oriented to be approximately parallel to the inner edge of the first panel 110. The first cross-member 162 is rotatably coupled to the pivot fitting 170 about axis 310. The first cross-member 162 includes a bearing element 166 extending laterally from each end of the cross-member.

A U-shaped channel 184 is formed in each guide 180, and each bearing element 166 extends into one of the U-shaped channels. The bearing elements 166 are disposed within the U-shaped channels 184 such that the first cross-member 162 is translatable along the length of the U-shaped channels. In addition, the first cross-member 162 is rotatable relative to the guides 180 about an axis 312. To allow for rotation about axis 312, the bearing elements 166 are rotatable within the U-shaped channels 184 and/or the bearing elements are rotatable relative to the first cross-member 162. Thus, the first cross-member 162 is supported at one edge by the pivot fitting 170 and at the other edge by the engagement of the bearing elements 166 with the U-shaped channels 184 of the guides 180.

The remainder of the retractable panel 160 is formed by additional cross-members 164 arranged in seriatim, wherein each of the additional cross-members is similar to the first cross member 162. The first of the additional cross-members 164 is rotatably coupled at a first edge to the first cross-member 162 about axis 312. The first additional cross-member 164 is supported at a second edge by bearing elements 168 that extend from each end, each bearing element engaging one of the U-shaped channels 184 formed in the guides 180. Each subsequent cross-member 164 is similarly supported at one edge by rotational attachment about axis 312 to the adjacent cross-member 164 and at a second edge by engagement of the bearing elements 168 with the U-shaped channels 184 of the guides 180. The cross-members 162 and 164 are sized and configured to provide a sufficiently stiff and durable walking surface when the operable ramp 100 is in the raised position and, as will be described in detail, to retract along the length of the U-shaped channels 184 when the operable ramp moves to the lowered position.

Figure 12:
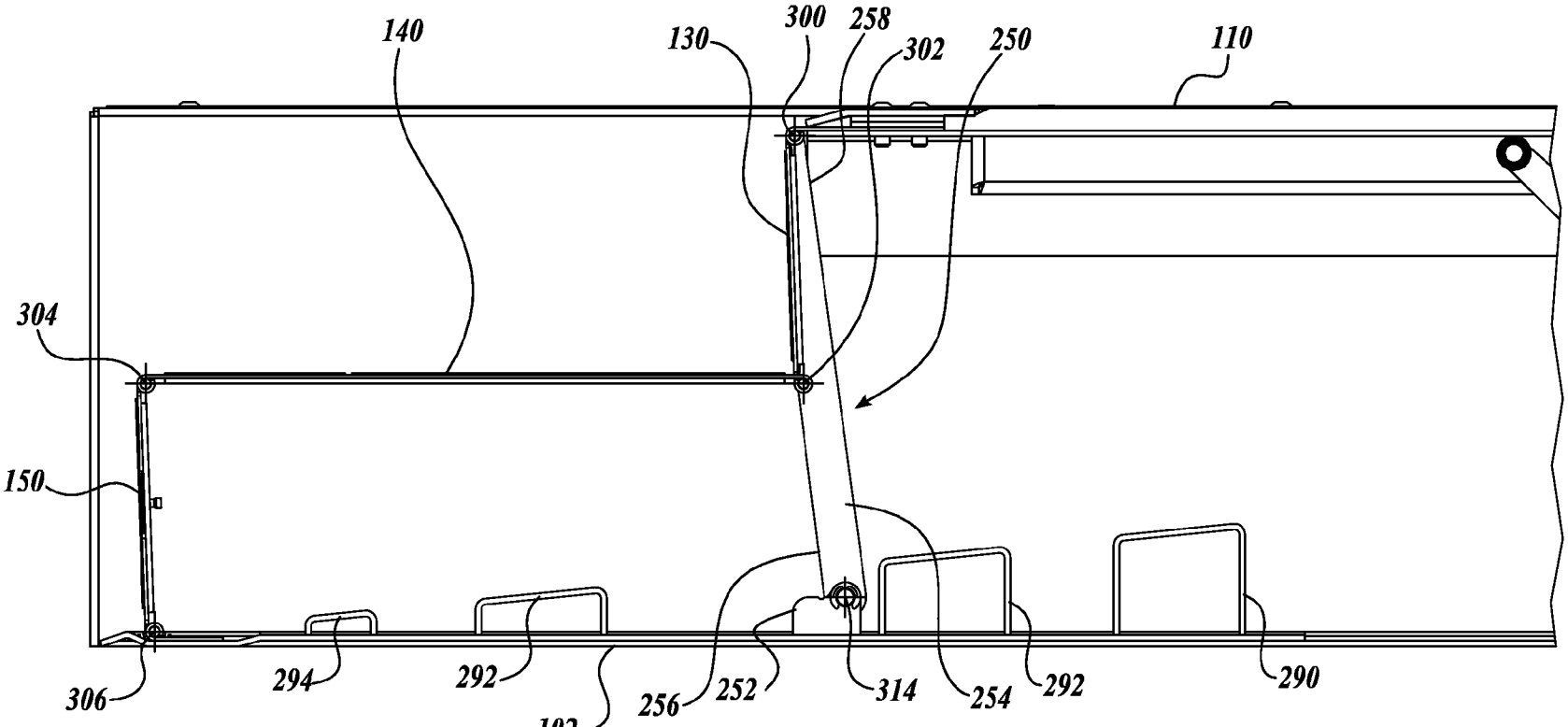
FIG. 12 shows a cutaway side view of a support link of the operable ramp of FIG. 8 with the operable ramp in the raised position.
Figure 13:
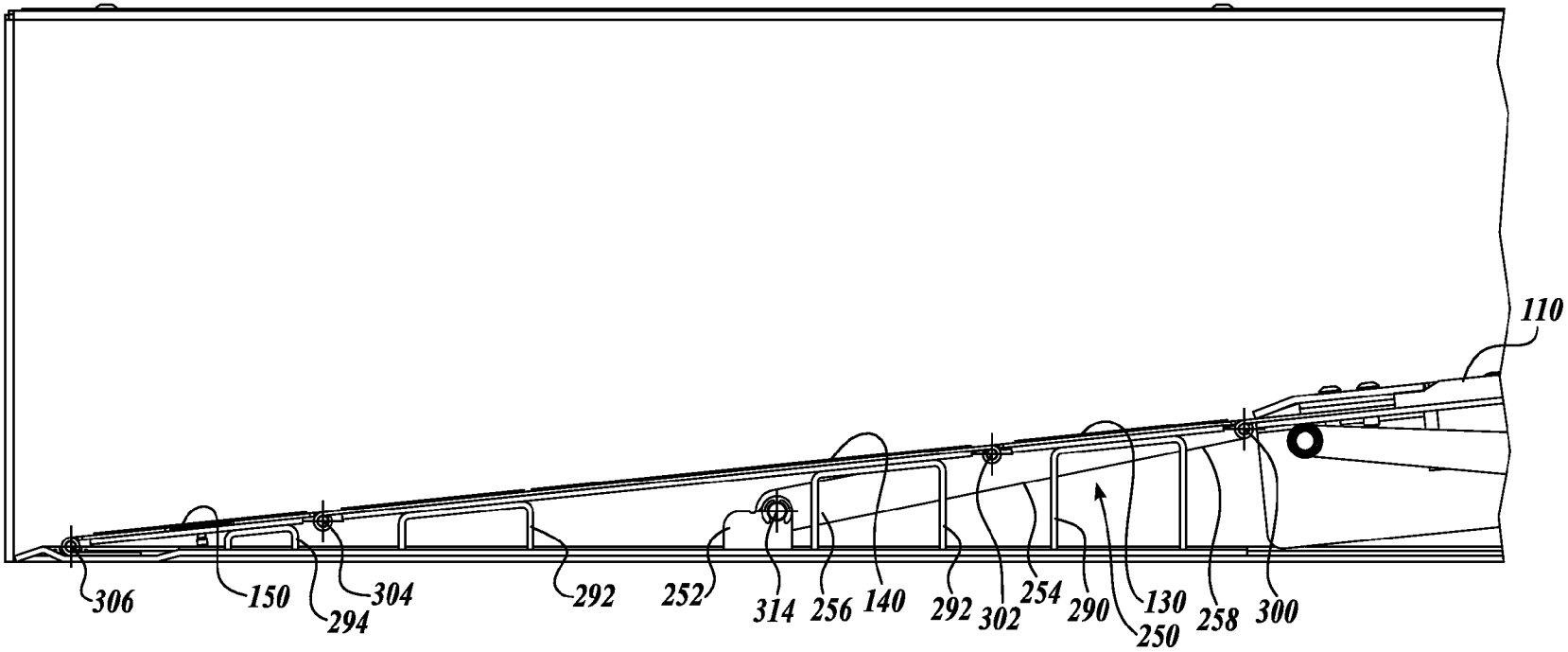
FIG. 13 shows a cutaway side view of the support link of FIG. 8 with the operable ramp in the lowered position.

Referring now to FIGS. 12 and 13, a support assembly 250 supports the outer end 114 of the first panel 110 when the operable ramp 100 is in the raised position. The support assembly includes a support fitting 252 mounted to the frame 102 or another fixed structure. A link 254 is rotatably coupled at a first end 256 to the support fitting 252 about an axis 314. A second end 258 of the link is rotatable coupled to the first panel 110 about axis 300 (the same axis about which the first panel 110 is coupled to the second panel 130). The link 254 is also rotatably coupled to the third panel 140 about axis 302 (the same axis about which the second panel 130 is coupled to the third panel 140). As a result of this configuration, the second panel 130 is secured to the link 254 by virtue of being coupled thereto at axes 300 and 302 and, therefore, is rotatably coupled to the frame 102 about axis 314.

As best shown in FIG. 6, a support assembly 250 is positioned at each end of the second panel 130. It will be appreciated that the number and location of the support assemblies 250 can vary. In one contemplated embodiment, a single support assembly 250 is positioned in the center of the second panel 130. In other possible embodiments, three or more support assemblies are spaced across the length of the second panel 130.

It will further be appreciated that the support links 254 need not be secure to the second panel 130 about axes 300 and 302. In one alternate embodiment, the support links 254 are rotatably coupled to the first and third panels 110 and 140, and the second panel 130 is not directly coupled to the adjacent panels at all, but is instead fixedly coupled to the support links. For this and other alternate embodiments, the rotation of the support links 254 moves the outer end 114 of the first panel 110 and the inner end 142 of the third panel 140 along arcuate paths about axis 314. The second panel 130 is secured to the operable ramp 100 in any number of suitable ways and is configured to span at least a portion of the distance between the first and third panels 110 and 140 when the operable ramp is in the raised and lowered positions. These and other embodiments for moving the outer end 114 of the first panel 110 and the inner end 142 of the third panel 140 along arcuate paths are contemplated and should be considered within the scope of the present disclosure.

Referring now to FIGS. 6, 7, 10, and 11, the operable ramp 100 includes a drive assembly 200 to selectively reciprocate the operable ramp between the raised position and the lowered position. In the disclosed embodiment, the drive assembly 200 includes a motor 202 disposed below the first panel 110. The motor 202 is operably coupled to a drive shaft 204 by a known transmission 206 so that the motor selectively rotates the drive shaft about a fixed axis 316. The drive shaft 204 is coupled to a first end of a pair of drive links 210, which form part of a linkage 208. Rotation of the drive shaft 204 rotates the drive links 210 about axis 316. A second end of the drive links 210 is rotatably coupled about axis 318 to one end of a pair of slave links 212. A second end of the pair of slave links 212 is rotatably coupled to the first panel 110 about an axis 320.

In the illustrated embodiment, the slave link is coupled to a linkage fitting 216 that is secured to a stiffener 214 located on the bottom of the first panel 110; however, it will be appreciated that any suitable configuration for rotatably coupling the slave link to the first panel can be utilized and should be considered within the scope of the present disclosure. Further, while the illustrated embodiment includes pairs of drive links 210 and slave links 212, it will be appreciated that single links can be utilized for the drive links, slave links, or both. Moreover, one of ordinary skill in the art will appreciate that various different drive assemblies 200 may be utilized to actuate the operable ramp 100 between the raised and lowered position. Among these alternate embodiments are different linkages, chain drives, cable drives, cams, and the like. In addition, while the illustrated motor 202 utilizes rotary motion to drive the operable ramp 100, it will be appreciated that linear actuators or any other suitable actuator or combination of actuators may be used and such variations should be considered within the scope of the present disclosure.

As best shown in FIG. 6, a controller 240 is operably coupled to the motor 202. The controller 240 receives input from an operator and selectively controls the motor 202 to reciprocate the operable ramp 100 between the raised position and the lowered position. More specifically, the controller 240 controls the motor 202 to rotate the drive shaft 204 in a first direction to move the operable ramp 100 toward the lowered (ramp) position and in a second direction to move the operable ramp toward the raised (step) position.

As best shown in FIG. 6, position sensors 222 and 226 are located proximate to the drive shaft 204. The first position sensor 222 senses a first target 224, which is mounted to the drive shaft 204, when the operable ramp 100 is in the raised position. The second position sensor 226 senses a second target 228, which is also mounted to the drive shaft 204 when the operable ramp is in the lowered position. The first and second position sensors 222 and 226 send signals to the controller 240 indicating the position of the operable ramp 100. It will be appreciated that various other sensor configurations can be employed to signal the position of the operable ramp, and the use of such alternate configurations should be considered within the scope of the present disclosure.

Figure 7:
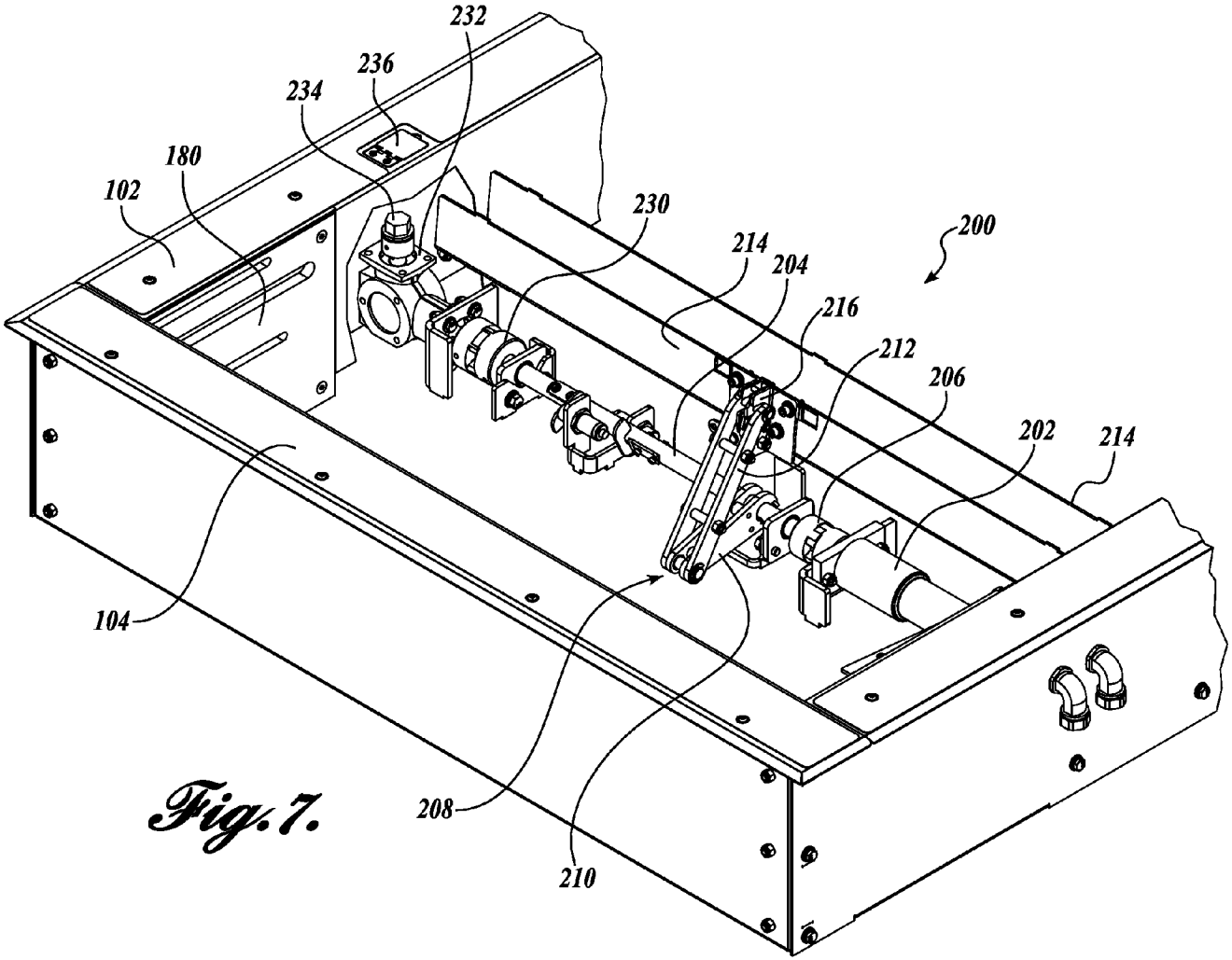
FIG. 7 shows a partial cutaway rear isometric view of the operable ramp of FIG. 4 in the lowered position.

Referring now to FIGS. 6 and 7, the drive shaft 204 is operably coupled by a second transmission 230 to the output shaft of a gearbox 232. The gearbox 232 includes an upward facing input shaft 234 having a hexagonal shape that is accessible from above the operable ramp through an access hole 236 in the frame 102.

In the event of a loss of power or a motor failure, an operator can actuate the operable ramp 100 manually. To do so, the operator inserts a crank through the access hole 236 onto the input shaft 234 of the gearbox 232 and rotates the crank in a first direction to move the operable ramp 100 toward the lowered position, and in a second direction to move the operable ramp toward the raised position. It will be appreciated that a number of variations to the illustrated manual raise/lower mechanism can be incorporated. In this respect, the size, position, and configurations of mechanisms that transfer a manual input into rotation of the drive shaft 204 can vary, and such variations should be considered within the scope of the present disclosure.

Figure 16:
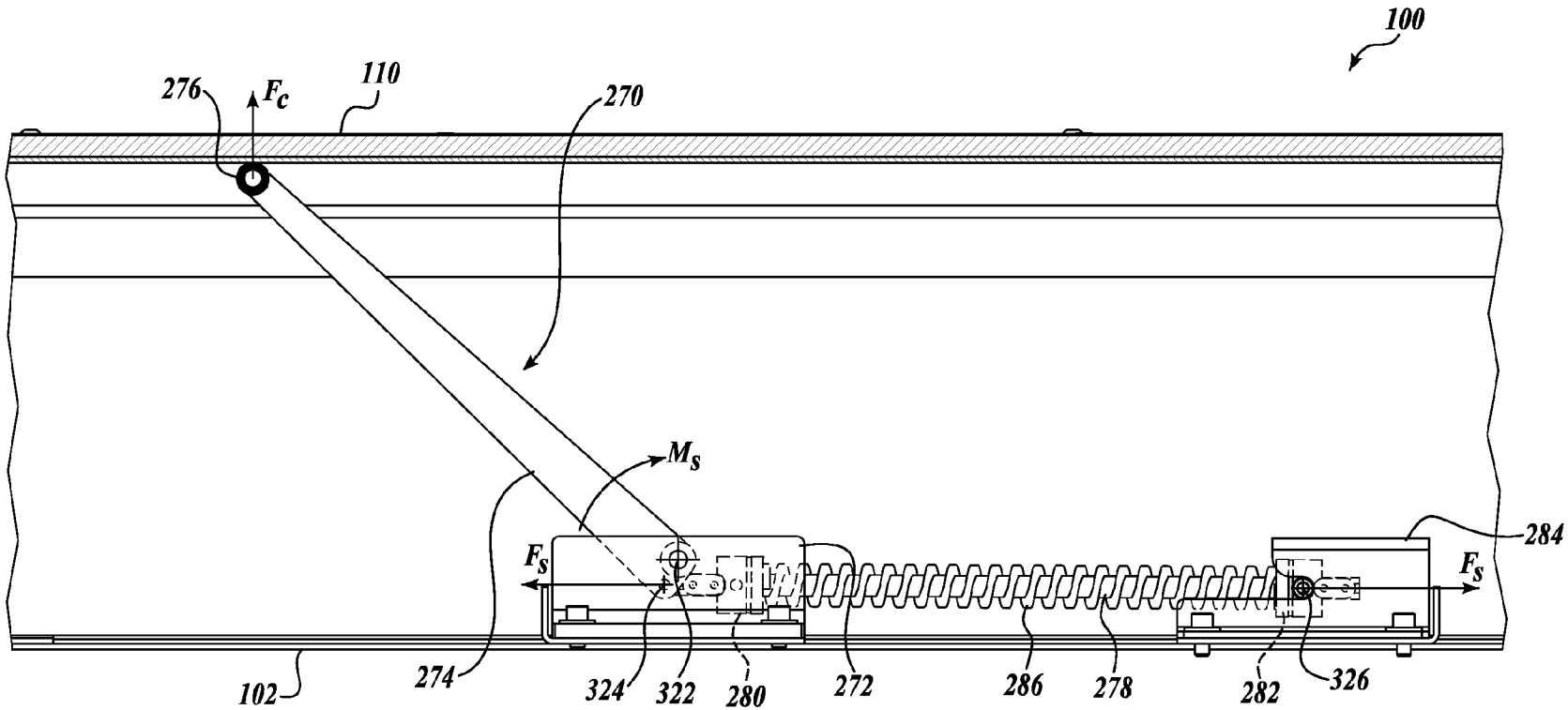
FIG. 16 shows a cutaway side view of a support link of the operable ramp of FIG. 8 with the operable ramp in the raised position.
Figure 17:
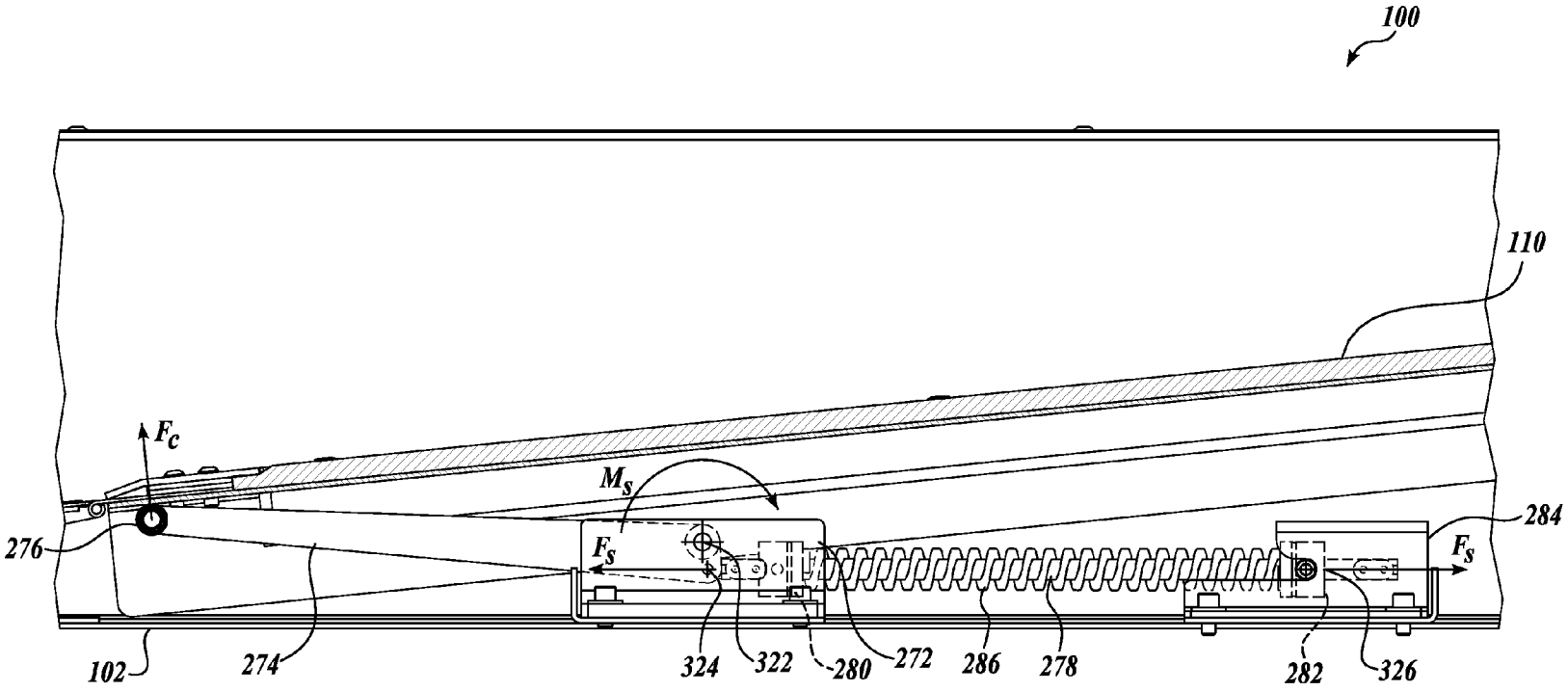
FIG. 17 shows a cutaway side view of the support link of FIG. 8 with the operable ramp in the lowered position.

Referring now to FIGS. 6, 16, and 17, as the operable ramp 100 transitions between the upper position and the lower position, the drive assembly 200 supports the weight of the ramp panels. More specifically, while the inner end of the first panel 110 is supported by the pivot fitting 170, the outer portion of the first panel 110, as well as the second, third and fourth panels 130, 140, and 150 are supported by the linkage 208 and the motor 202. Not only must the motor support the weight of the panels, it must drive the panels upward to transition the operable ramp 100 from the lowered position to the raised position.

In order to reduce the size of the actuating force required from the motor 202 and to reduce wear and tear on the drive assembly 200 components in general, the operable ramp 100 includes a counterbalance 270 disposed below the first panel 110. The counterbalance 270 applies an upward force $F_C$ to the bottom of the first panel 100 to counteract at least a portion of the weight of the ramp panels. In doing so, the counterbalance allows for the use of a smaller, more compact motor 202 and prolongs the life of the drive assembly 200.

As shown in FIGS. 16 and 17, the counterbalance 270 includes a fitting 272 coupled to the frame 102 or other suitable structure below the first panel 110. A link 274 is rotatably coupled at one end to the fitting 272. A second end of the link has a roller bearing 276 or other suitable bearing element or surface disposed thereon. The roller bearing 276 rollingly or slidingly engages a lower surface of the first panel 110. In contemplated alternate embodiments a static bearing surface is disposed at the end of the link and slidingly engages the first panel.

A rod 278 is rotatably coupled at one end to the link 274 about axis 324 so that rotation of the link 274 rotates the end of the rod about axis 322. A biasing element 280 in the form of a cylindrical fitting is fixedly coupled to the rod 278 proximate to the link 274. A spring fitting 282 is slidably coupled to the rod 278 opposite the biasing element 280. The spring fitting 282 is rotatably coupled to a mounting fitting 284 about axis 326. The mounting fitting 284 is mounted to the frame 102 or some other suitable fixed structure.

A spring 286 is disposed between the biasing element 280 and the spring fitting 282. In the illustrated embodiment, the spring 286 is a compression spring positioned such that the rod 278 extends through the coils of the spring. The spring 286 engages the biasing element 280 and the spring fitting 282, which are configured such that the ends of the spring are restrained thereby. The spring 286 is sized and configured to have a preload that is reacted by the biasing element 280 and the spring fitting 282. The spring fitting 282 is rotatably coupled to the mounting fitting 284 and, therefore, the spring force $F_S$ applied to the spring fitting by one end of the spring 286 is reacted out through the mounting fitting. The spring force $F_S$ applied to the biasing element 280 at the other end of the spring is reacted out through the rod 278 by virtue of its fixed connection to the biasing element. As a result, the spring force $F_S$ is applied to the link 274 through axis 324.

The spring force $F_S$ applied to the link 274 results in a moment $M_S$ about axis 322. The moment $M_S$ is reacted through roller bearing 276 into a lower surface of the first panel 110. That is, the roller bearing 276 applies a counterbalance force $F_C$ to the first panel 110. The counterbalance force $F_C$ is applied normal to the lower surface of the first panel 110 and biases the first panel and, therefore, the operable ramp 100 toward the raised position.

When the operable ramp 100 moves from the raised position to the lowered position, link 274 rotates in a counter-clockwise direction, as viewed in FIGS. 16 and 17. This rotation moves the biasing element 280 toward the spring fitting 282, thereby compressing the spring 286, which increases the spring force $F_S$. The magnitude of the moment arm between axis 322 and the line of action of spring force $F_S$ does not change appreciably between the raised and lower position, so the magnitude of the moment $M_S$ increases as the operable ramp 100 moves toward the lowered position due to the spring compression. At the same time, the moment arm between axis 322 and the line of action of counterbalance force $F_C$ increases as the operable ramp moves toward the lowered position. As a result, the counterbalance force $F_C$ tends to decrease as the operable ramp moves toward the lowered position.

It will be appreciated that the counterbalance 270 can be configured to provide a desired counterbalance force $F_C$ throughout the motion of the ramp. In this regard, the spring preload, spring constant k of the spring, the magnitude and variation of the moment arm throughout the travel of the operable ramp, as well as other factors can be modified to provide a desired performance curve. Further, multiple springs, various other types of springs, such as torsion springs, extension springs, non-linear springs, gas springs, etc., may be employed to provide a particular counterbalancing profile. These and other alternate configurations that provide a biasing force can be implemented and should be considered within the scope of the present disclosure.

As shown in FIG. 8, when the operable ramp 100 is in the raised (step) position, the first panel 110 provides a generally horizontal "tread" portion upon which able bodied persons can walk. The inner end 112 of the first panel 110 is supported by the engagement of the pivot fitting 170 with the elongate slots 182 formed in the guides 180, as illustrated in FIG. 14. The retractable panel 160 extends inwardly from the inner end 112 of the first panel 110 to provide a transition surface between the first panel and a fixed panel 104 positioned at the inner end of the frame 102.

The second panel 130 extends downward from the outer end 114 of the first panel 110 to provide a "riser" to the upper step. The second panel 130, the outer end 114 of the first panel 110, and the inner end 142 of the third panel 140 are all supported by the links 254 of the support assemblies 250 when the operable ramp 100 is in the raised position, as best shown in FIG. 12. In the illustrated embodiment, the axis 300 between the first and second panels 110 and 130 is offset from the axis 314 about which the links 254 rotate. As a result, the weight of the first, second, and third panels (and the weight of any people walking thereon) tends to rotate the links 254 counterclockwise as viewed in FIG. 8. In the event of a power outage or drive system failure, the links 254 will tend to rotate in the counterclockwise direction, but will be restrained by the first panel 110, the inner end 112 of which is restrained by the engagement of the pivot fitting 170 with the outer end of the elongate slots 182. In this manner, the operable ramp 100 is maintained in a raised position, even in the event of a power outage or drive system failure.

To move the operable ramp 100 from the raised position to the lowered position, the motor 202 rotates the drive shaft 204 in a first direction (clockwise as viewed in FIG. 8). The drive shaft 204 rotates the drive link 210 about axis 316, which in turn drives the slave link 212. Movement of the slave link 212 drives the first panel 110 toward the fixed panel 104. As the first panel 110 moves toward the fixed panel 104, the retractable panel 160 retracts to accommodate the decreased distance between the first panel and the fixed panel. More specifically, movement of the first panel 110 drives the pivot fitting 170 along the elongate slots 182, which, in turn, drives the retractable panel 160 along the path of the U-shaped channels 184 so that some or all of the retractable panel retracts below the fixed panel 104. With the retractable panel 160 in the retracted position, only enough of the retracted panel required to transition from the first panel 110 to the fixed panel 104 remains exposed.

As the first panel 110 moves toward the fixed panel 104, the outer end 114 of the first panel pulls the link 254 to rotate the link in the clockwise direction (as viewed in FIG. 8) about axis 314. As the link 254 rotates, axes 300 and 302 move downward along arcuate paths, thereby lowering the outer end 114 of the first panel 110 and the inner end 142 of the third panel 140. Lowering the outer end 114 of the first panel 110 causes the first panel to rotate about axis 308. Movement of axis 302 also moves the third panel 140 so that axis 304 and therefore, the fourth panel 150, rotate about axis 306. The first, second, third, and fourth panels 110, 130, 140, and 150 move according to the translation of axis 308 and the movement of axes 300, 302, and 304 until the operable ramp 100 reaches the lowered position of FIG. 9.

When the operable ramp 100 is in the lowered position, the first, second, third, and fourth panels 110, 130, 140, and 150 are approximately parallel and cooperate to provide an inclined transition surface between the fixed panel 104 and the first surface 62 shown in FIG. 3. Although the panels of the illustrated embodiment are approximately parallel in the lowered position, i.e., they form an angle of approximately 180° relative to each other, other embodiments are contemplated in which any two or more of the panels are not parallel in the lowered position. In this regard, embodiments are possible in which two or more of the panels form an angle in the range of 135° to 225°.

In the illustrated embodiment, the frame 102 includes a number of supports 290, 292, and 294 formed at the bottom of the frame. As illustrated, the supports 290, 292, and 294 are inverted C-channels, but any suitable support configuration can be utilized. The supports 290, 292, and 294 are sized and configured to engage the second panel 130, third panel 140, and fourth panel 150, respectively, when the operable ramp 100 is in the lowered position. Thus, as shown in FIG. 13, support 290 provides additional support to the second panel 130, supports 292 provide additional support to the third panel 140, and support 294 provides additional support to the fourth panel 150. Support 290 also supports the outer end 114 of the first panel 110 by supporting the second panel 130 and link 254.

The supports 290, 292, and 294 provide improved ramp stability and also prevent a sudden drop of the panels in the event of a power outage or drive system failure. It will be appreciated that the position, shape, number, and location of the supports can vary. These and other variations of the supports should be considered within the scope of the present disclosure.

Figure 9:
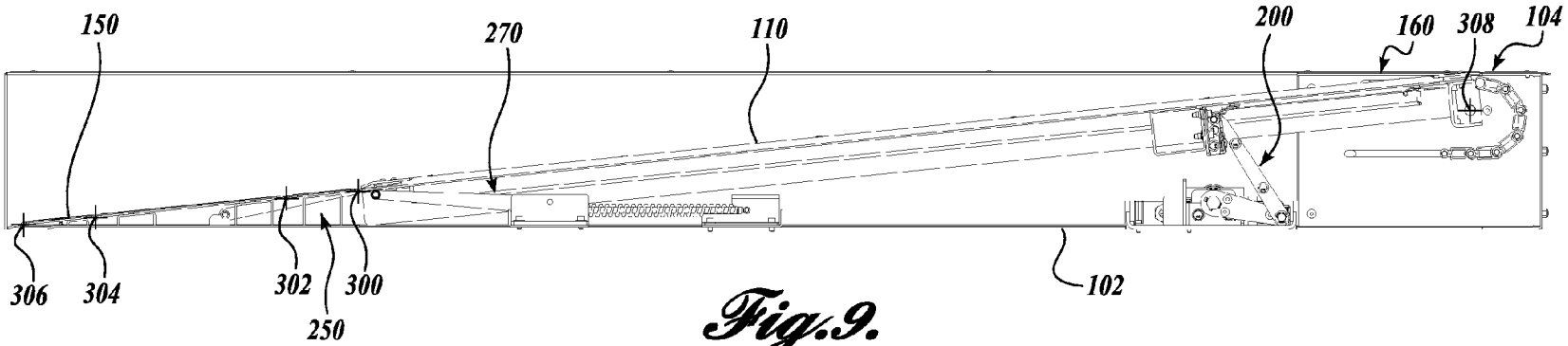
FIG. 9 shows a cutaway side view of the operable ramp of FIG. 4 in the lowered position.
Figure 10:
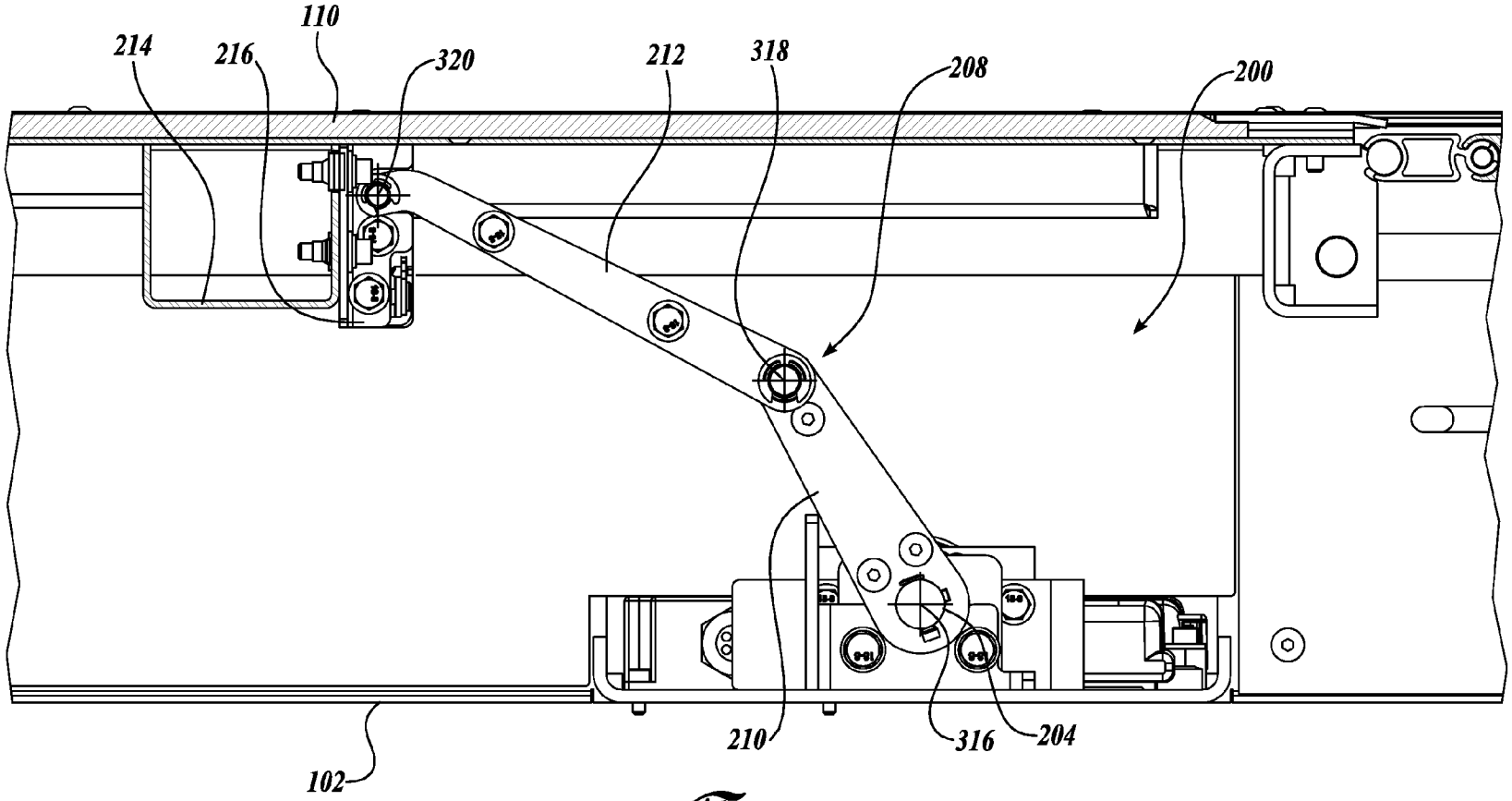
FIG. 10 shows a cutaway side view of a drive linkage of the operable ramp of FIG. 8 with the operable ramp in the raised position.
Figure 11:
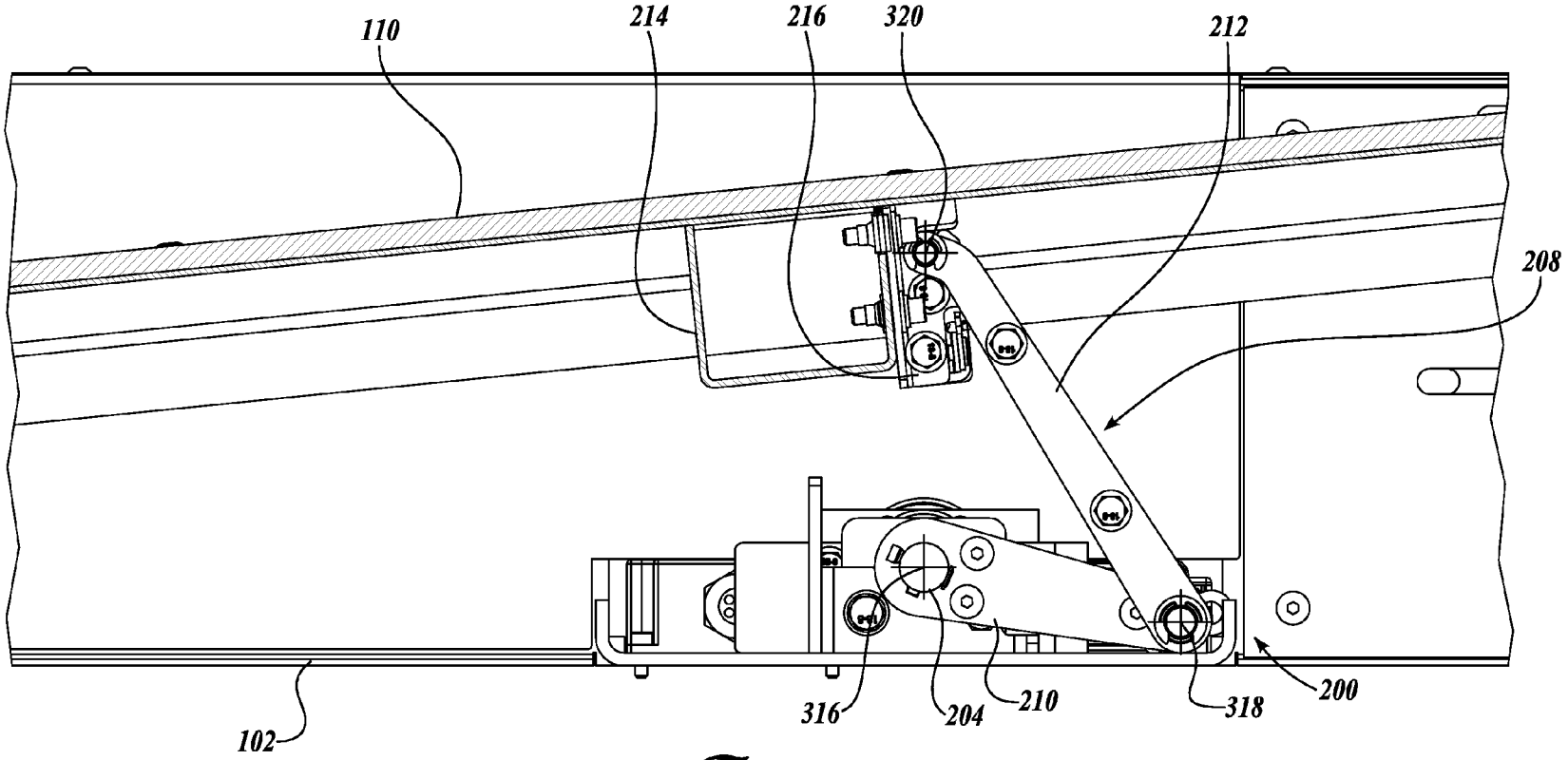
FIG. 11 shows a cutaway side view of the drive linkage of FIG. 8 with the operable ramp in the lowered position.

To move the operable ramp 100 from the lowered position to the raised position, the motor 202 rotates the drive shaft 204 in a second direction (counterclockwise as viewed in FIG. 9). The drive shaft 204 rotates the drive link 210 about axis 316, which in turn drives the slave link 212. Movement of the slave link 212 drives the first panel 110 away from the fixed panel 104. Movement of the inner end 112 of the first panel 110 is controlled by the translation of the pivot fitting 170 along the elongate slots 182. Movement of the outer end 114 of the first panel 110 is controlled by the rotational attachment of the link 254 about axis 314, which moves upward along an arcuate path, moving the second panel 130 and the inner end 142 of the third panel 140 with it.

As the first panel 110 moves away from the fixed panel 104, movement of the first panel 110 pulls the pivot fitting 170 away from the fixed panel. As the pivot fitting 170 moves away from the fixed panel 104, the pivot fitting pulls the retractable panel 160 into the extended position of FIG. 8. That is, the pivot fitting 170 pulls the retractable panel 160 along the path of the U-shaped channels 184 so that the retractable panel extends from the first panel 110 to the fixed panel 104. When in the extended position, the retractable panel 160 provides a transition surface between the first panel 110 and the fixed panel 104.

Rotation of the drive link 210 continues until the operable ramp 100 reaches the raised position of FIG. 8. In the raised position, the first panel 110 and retractable panel 160 cooperate to form a surface upon which able body persons can walk, and the second panel 130 extends downward from the outer end 114 of the first panel 110. Thus, the first panel 110 and second panel 130 form the tread and riser, respectively, of the upper step 106. At the same time, the third panel 140 extends horizontally outward from the lower end 134 of the second panel 130, and the fourth panel 150 extends downward from the outer end 144 of the third panel 140, so that the third panel and fourth panel form the tread and riser, respectively, of the lower step 108

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The embodiments of the invention in which an exclusive property or privilege is claimed are defined as follows:

1. An operable ramp moveable between a raised position and a lowered position, the operable ramp forming a pair of steps in the raised position, the operable ramp comprising:

(a) a first panel rotatably coupled at a first end about a first axis, the first axis moving in a first direction when the operable ramp moves toward the lowered position and in a second direction when the operable ramp moves toward the raised position;

(b) a link rotatably coupled at a first end to a second end of the first panel about a second axis, the link extending downward from the first panel in the raised position and rotating about a fixed third axis when the operable ramp moves from the raised position to the lowered position;

(c) a second panel rotatably coupled at a first end to the link about a fourth axis located between the second axis and the third axis;

(d) a third panel rotatably coupled at a first end to a second end of the second panel about a fifth axis, the fifth axis rotating about a fixed sixth axis when the ramp moves between the raised and lowered positions, and (e) a linkage operably coupled to the first panel, the linkage selectively rotating the first panel about the first axis.

2. The operable ramp of claim 1, wherein the first panel, the second panel, and the third panel cooperate to provide at least a portion of an inclined surface when the operable ramp is in the lowered position.

3. The operable ramp of claim 1, further comprising a fourth panel rotatable coupled at a first end to the first panel about the second axis and rotatably coupled at a second end to the first end of the second panel about the fourth axis, the fourth panel extending downward from the first panel when the operable ramp is in the raised position.

4. The operable ramp of claim 3, wherein the first panel, the second panel, the third panel, and the fourth panel cooperate to provide at least a portion of an inclined surface when the operable ramp is in the lowered position.

5. The operable ramp of claim 1, further comprising a fourth panel fixedly coupled to the link, wherein the first panel, the second panel, the third panel, and the fourth panel cooperate to provide at least a portion of an inclined surface when the operable ramp is in the lowered position.

6. The operable ramp of claim 1, further comprising a guide having an elongate slot, the first axis moving along the slot when the operable ramp moves between the raised position and the lowered position.

7. The operable ramp of claim 1, further comprising a counterbalance link rotatable about a fixed seventh axis, the counterbalance link moveably engaging a bottom portion of the first panel to apply an upward force to the first panel.

8. The operable ramp of claim 7, the counterbalance link comprising a roller bearing in rolling engagement with the first panel.

9. The operable ramp of claim 1, the linkage comprising a drive link selectively rotatable in a first direction and a second direction.

10. The operable ramp of claim 9, the linkage further comprising a second link rotatably coupled at a first end to the drive link, a second end of the second link being rotatably coupled to the first panel.

11. An operable ramp moveable between a raised position and a lowered position, the operable ramp forming a pair of steps in the raised position, the operable ramp comprising:

(a) a first panel rotatably coupled at a first end about a first axis, the first axis moving in a first direction when the operable ramp moves toward the lowered position and in a second direction when the operable ramp moves toward the raised position;

(b) a second panel rotatably coupled at a first end to a second end of the first panel, the second panel extending downward from the first panel in the raised position and rotating about a fixed second axis when the operable ramp moves from the raised position to the lowered position, (c) a third panel rotatably coupled at a first end to a second end of the second panel, the third panel extending outward from the second panel when the ramp is in the raised position; and (d) a fourth panel rotatably coupled at a first end to a second end of the third panel, the fourth panel extending downward from the third panel in the raised position and rotating about a fixed third axis when the operable ramp moves from the raised position to the lowered position.

12. The operable ramp of claim 11, the first, second, third, and fourth panels cooperating to provide an inclined surface when the operable ramp is in the lowered position.

13. The operable ramp of claim 11, further comprising a fifth panel rotatably coupled to the first end of the first panel and providing a surface between the first panel and a fixed panel.

14. The operable ramp of claim 13, wherein the sixth panel is a fixed panel and the fifth panel is operably associated with a channel, the channel guiding movement of the fifth panel when the operable ramp moves from the raised position to the lowered position.

15. The operable ramp of claim 14, wherein the channel is a U-shaped channel.

16. The operable ramp of claim 14, wherein at least a portion of the fifth panel is disposed beneath the sixth panel when the operable ramp is in the lowered position.

17. The operable ramp of claim 11, further comprising a linkage operably coupled to the first panel, the linkage selectively rotating the first panel about the first axis.

18. The operable ramp of claim 11, further comprising a counterbalance link rotatable about a fixed fourth axis, the counterbalance link moveably engaging a bottom portion of the first panel to apply an upward force to the first panel.

19. The operable ramp of claim 18, the counterbalance link comprising a roller bearing in rolling engagement with the first panel.

* * * * *